US006622679B2

(12) United States Patent
Bretting et al.

(10) Patent No.: US 6,622,679 B2
(45) Date of Patent: Sep. 23, 2003

(54) CUP TAPPET

(75) Inventors: Werner Bretting, Herzogenaurach (DE); Hans Monius, Adelsdorf (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 10/141,106

(22) Filed: May 8, 2002

(65) Prior Publication Data

US 2002/0170516 A1 Nov. 21, 2002

(30) Foreign Application Priority Data

May 17, 2001 (DE) ..... 101 23 966

(51) Int. Cl.[7] ..... F01L 1/14

(52) U.S. Cl. ..... 123/90.55; 123/90.58; 123/90.48

(58) Field of Search ..... 123/90.53, 90.58, 123/90.48, 90.5, 90.52, 90.55

(56) References Cited

U.S. PATENT DOCUMENTS 5,226,389 A * 7/1993 Buuck ..... 123/90.48
5,231,960 A * 8/1993 White ..... 123/90.16
5,379,730 A * 1/1995 Schaeffler ..... 123/90.55
5,988,128 A * 11/1999 Moriya et al. ..... 123/90.18
6,021,751 A * 2/2000 Spath ..... 123/90.55

FOREIGN PATENT DOCUMENTS

| | | |
|---|---|---|
| DE | 1966968 | 8/1967 |
| DE | 3445823 | 6/1986 |
| FR | 0454518 | 10/1991 |

* cited by examiner

*Primary Examiner*—Thomas Denion
*Assistant Examiner*—Jaime Corrigan
(74) *Attorney, Agent, or Firm*—Muserlian, Lucas and Mercanti

(57) ABSTRACT

The cup tappet (1) of the invention for a valve train of an internal combustion engine comprises a hollow cylindrical skirt (2) whose one end (3) is connected to a bottom (5) for making contact with a cam. The skirt (2) has a clearly smaller height than the overall height of the cup tappet (1), and the bottom (5) rises in a roof-like taper from said end (3). By virtue of this configuration, the bottom (5) has a very high rigidity, so that it is possible to minimize its thickness 'd' significantly compared to thicknesses of prior art cup tappet bottoms.

9 Claims, 1 Drawing Sheet

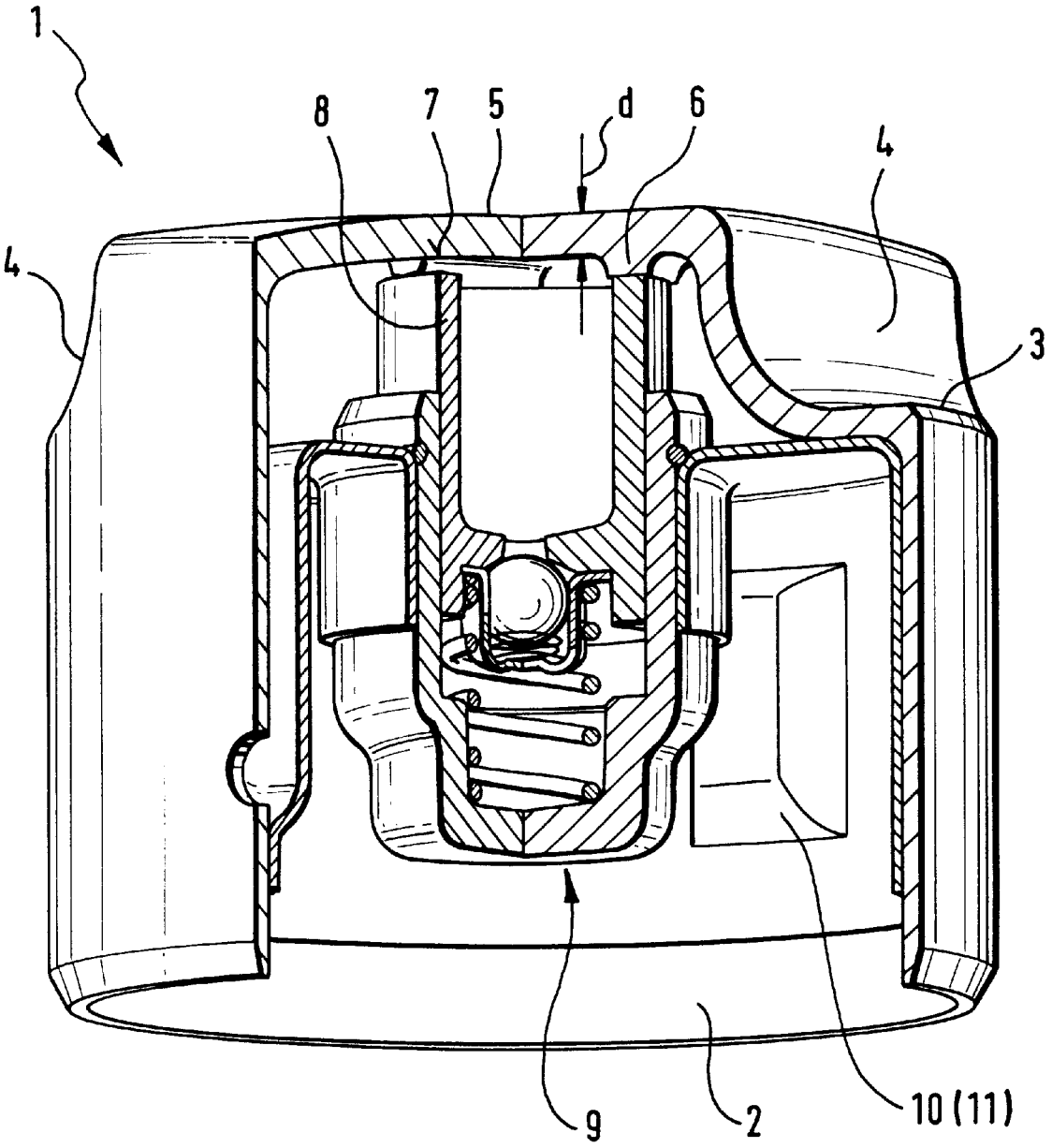
1
8
7
5
d
6
4
4
3
9
2
10 (11)

CUP TAPPET

FIELD OF THE INVENTION

The invention concerns a cup tappet for a valve train of an internal combustion engine, said cup tappet comprising a hollow cylindrical skirt whose one end is connected to a bottom for making contact with a cam.

BACKGROUND OF THE INVENTION

A generic cup tappet of the pre-cited type known from the document DE 41 15 668 A1 comprises a hydraulic clearance compensation element. A drawback of this tappet is its relatively solid configuration, particularly in the region of the bottom. Due to this, the oscillating mass of the valve train is unnecessarily increased so that the amount of work that has to be performed in the valve train is too large.

OBJECTS OF THE INVENTION

It is an object of the invention to provide an improved cup tappet of the pre-cited type that is optimized with regard to its weight.

This and other objects and advantages of the invention will become obvious from the following detailed description.

SUMMARY OF THE INVENTION

The invention achieves the above objects by the fact that a height of the skirt is clearly smaller than an overall height of the cup tappet, and the bottom rises in a roof-like taper from the end of the skirt.

According to a particularly advantageous feature of the invention, the bottom has a rectangular shape extending in a direction of outward travel of a cam-contacting surface.

Due to this roof-like "rise" of the bottom, the rigidity in this region is enhanced. This, in its turn, permits a significant reduction of the thickness of the bottom to about 1.2 mm. At the same time, as a result of the simultaneous reduction of the height of the skirt and the overall surface of the bottom, the total surface requiring fine machining is small. This has an advantageous effect on the cost and work of fabrication.

Although it is particularly proposed that the bottom have a rectangular shape, so that two parallel sides extend from the end of the skirt toward the bottom, it is possible, if required, to realize a frustoconical configuration with a circular bottom. In this case, however, only a relatively small contact surface for the cam is formed on the bottom.

According to a further proposition of the invention, the parallel sides extending toward the bottom can have a concave configuration, but it is also conceivable that these sides form a trapezoidal shape.

According to another feature of the invention, the surface of the bottom that makes contact with the cam may have a slightly cylindrical shape. In this way, a larger contact surface is generated for contacting the cam.

Advantageously, the bottom is made in one piece with the sides and the skirt. However, a multi-piece structure involving a joining method, for example, is also conceivable.

For rigidifying the bottom, at least one stiffening rib can be provided on the inner surface of the bottom. Another possibility is to provide two opposing kidney-shaped stiffening ribs. If the cup tappet possesses a hydraulic clearance compensation element, an inner piston of the clearance compensation element can abut against the stiffening ribs, and this leads, at the same time, to the forming of an oil transfer passage from the tappet oil reservoir to the reservoir of the clearance compensation element.

It is proposed, particularly if the bottom has a rectangular shape, to provide an anti-rotation device in the skirt. This can be done using a means, known per se, for example, needle rollers, balls, wedges and the like.

According to a final proposition of the invention, the bottom has a general thickness of about 1.2 mm. This can be achieved by an optimization of rigidity using calculations based on finite element methods. Prior art cup tappets have a bottom thickness of about 1.8 mm.

As indicated above, the invention equally concerns both hydraulic and mechanical tappets.

The invention will now be described with reference to the appended drawing.

BRIEF DESCRIPTION OF THE DRAWING

The sole FIGURE is a tridimensional representation of a cup tappet of the invention, with a part thereof shown in section.

DETAILED DESCRIPTION OF THE DRAWING

The sole FIGURE discloses a cup tappet 1 comprising a hollow cylindrical skirt 2 having an end 3 oriented toward a cam, not shown. Two opposing sides 4 having, in the present embodiment, a concave configuration extend from the end 3 toward each other in cam-contacting direction. The sides 4 merge into a bottom 5 that serves for a direct contact with the cam. As seen in a top view, this bottom 5 has a rectangular shape while being slightly arched cylindrically.

Due to the roof-like tapered shape of the bottom 5, this region has a very rigid configuration. As a result, either the load on the tappet can be generally increased or, and this is the main aim of the invention, a thickness 'd' of the bottom can be significantly reduced compared to prior art bottom thicknesses to a value of about 1.2 mm.

In the drawing, one stiffening rib 6 arranged on an inner surface 7 of the bottom 5 can be clearly seen but, as described above, the tappet comprises two opposing kidney-shaped stiffening ribs 6. An inner piston 8 of a hydraulic clearance compensation element 9 abuts against these stiffening ribs 6. It can be seen further in the drawing that a recess 10 for an anti-rotation device 11 is provided in the skirt 2. This anti-rotation device 11 serves to guide the cup tappet 1 in a longitudinal groove of a reception of a cylinder head of an internal combustion engine.

What is claimed is:

1. A cup tappet for a valve train of an internal combustion engine, said cup tappet comprising a hollow cylindrical skirt whose one end is connected to a bottom for making contact with a cam, wherein a height of the skirt is clearly smaller than an overall height of the cup tappet, and the bottom rises in a roof-like taper from said end of the skirt, wherein the bottom has a rectangular shape extending in a direction of outward travel of a cam-contacting surface and the sides connecting the bottom to the skirt have a generally concave configuration.

2. A cup tappet of claim 1, wherein the bottom has a thickness 'd' in a range of 1.1 mm<d<1.85 mm.

3. A cup tappet of claim 1, wherein the bottom has a thickness 'd' of approximately 1.2 mm.

4. A cup of claim 1, wherein, as seen in the direction of outward travel, the bottom is cylindrically arched.

5. A cup tappet of claim 1, wherein the skirt comprises at least one anti-rotation device.

6. A cup tappet of claim 1, wherein the skirt comprises at least one anti-rotation device.

7. A cup tappet of claim 1 comprising a hydraulic clearance compensation element.

8. A cup tappet of claim 7, wherein an inner surface of the bottom comprises at least one integrally formed stiffening rib.

9. A cup tapped for a valve train of an internal combustion engine, said cup tappet comprising a hollow cylindrical skirt whose one end is connected to a bottom for making contact with a cam, wherein a height of the skirt is clearly smaller than an overall height of the cup tappet, and the bottom rises in a roof-like taper from said end of the skirt, and wherein an inner surface of the bottom comprises at least one integrally formed stiffening rib.

* * * * *